US007836979B2

(12) United States Patent
Green et al.

(10) Patent No.: US 7,836,979 B2
(45) Date of Patent: Nov. 23, 2010

(54) DRILL BITS AND TOOLS FOR SUBTERRANEAN DRILLING

(75) Inventors: James C. Green, Spring, TX (US); Michael L. Doster, Spring, TX (US); Jason E. Hoines, Montgomery, TX (US); Robert M. Welch, The Woodlands, TX (US); Danielle V. Roberts, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/260,245

(22) Filed: Oct. 29, 2008

(65) Prior Publication Data

US 2009/0107730 A1 Apr. 30, 2009

Related U.S. Application Data

(60) Provisional application No. 60/983,493, filed on Oct. 29, 2007.

(51) Int. Cl.
*E21B 10/42* (2006.01)
*E21B 10/46* (2006.01)

(52) U.S. Cl. ..... 175/428; 175/431

(58) Field of Classification Search ..... 175/428, 175/431, 426

See application file for complete search history.

(56) References Cited

U.S. PATENT DOCUMENTS

| | | | | |
|---|---|---|---|---|
| 4,253,533 | A | | 3/1981 | Baker, III |
| 4,351,401 | A | | 9/1982 | Fielder |
| 4,554,986 | A | * | 11/1985 | Jones ..... 175/397 |
| 4,932,484 | A | | 6/1990 | Warren et al. |
| 4,982,802 | A | | 1/1991 | Warren et al. |
| 5,010,789 | A | | 4/1991 | Brett et al. |
| 5,042,596 | A | | 8/1991 | Brett et al. |
| 5,090,492 | A | | 2/1992 | Keith |
| 5,238,075 | A | | 8/1993 | Keith et al. |
| RE34,435 | E | | 11/1993 | Warren et al. |
| 5,671,818 | A | | 9/1997 | Newton et al. |
| 5,697,461 | A | | 12/1997 | Newton et al. |
| D405,811 | S | | 2/1999 | Arfele et al. |
| 5,904,213 | A | | 5/1999 | Caraway et al. |
| 5,967,246 | A | | 10/1999 | Caraway et al. |
| 6,092,613 | A | | 7/2000 | Caraway et al. |
| 6,283,233 | B1 | | 9/2001 | Lamine et al. |
| 6,298,930 | B1 | | 10/2001 | Sinor et al. |
| 6,460,631 | B2 | | 10/2002 | Dykstra et al. |
| 7,048,081 | B2 | | 5/2006 | Smith et al. |
| 7,096,978 | B2 | | 8/2006 | Dykstra et al. |
| 2007/0151770 | A1 | | 7/2007 | Ganz |
| 2008/0289880 | A1 | | 11/2008 | Majagi et al. |
| 2008/0314645 | A1 | | 12/2008 | Hall et al. |

OTHER PUBLICATIONS

PCT International Search Report for International Application No. PCT/US2008/081510, mailed Feb. 25, 2009.

U.S. Appl. No. 12/428,260, filed Apr. 22, 2009, entitled "Drill Bits and Tools for Subterranean Drilling, Methods of Manufacturing Such Drill Bits and Tools and Methods of Off Center Drilling."

U.S. Appl. No. 11/865,258, filed Oct. 1, 2007, entitled "Drill Bits and Tools for Subterranean Drilling."

U.S. Appl. No. 11/865,296, filed Oct. 1, 2007, entitled "Drill Bits and Tools for Subterranean Drilling."

* cited by examiner

*Primary Examiner*—Giovanna C Wright
(74) *Attorney, Agent, or Firm*—TraskBritt

(57) ABSTRACT

A drill bit having a bit body includes a blade face surface on at least one blade extending longitudinally and radially outward over a face of the bit body. The blade face surface of the at least one blade includes a contact zone and a sweep zone. The sweep zone rotationally trails the contact zone with respect to a direction of intended bit rotation about a longitudinal axis of the bit body provides reduce rubbing contact when engaging with a subterranean formation.

20 Claims, 4 Drawing Sheets

DRILL BITS AND TOOLS FOR SUBTERRANEAN DRILLING

CROSS-REFERENCE TO RELATED APPLICATIONS

This application claims the benefit of U.S. provisional patent application Ser. No. 60/983,493, filed Oct. 29, 2007.

This application is also related to copending U.S. patent application Ser. No. 12/428,260, filed Apr. 22, 2009.

FIELD OF THE INVENTION

The invention, in various embodiments, relates to drill bits and tools for subterranean drilling and, more particularly, to a drill bit or tool incorporating structure for enhancing contact and rubbing area control responsive to weight-on-bit (WOB).

BACKGROUND

Fixed cutter rotary drill bits for subterranean earth boring have been employed for decades. It is well known that increasing the rotational speed of such drill bit, for a given weight-on-bit (WOB), and subject to the ability of the bit's hydraulic structure to adequately clear formation cuttings from the bit, increases the rate of penetration of the drill string. However, increased rate of penetration of the drill string is limited by the degree to which rubbing contact occurs between a face surface, particularly, the face surface of a blade of the drill bit coming in contact with a bottom hole, or drilling portion of a subterranean formation (i.e., substantially the horizontal facing surface of the bottom hole portion) while drilling.

Another recognized concern is that damage to cutting elements, commonly polycrystalline diamond compacts (PDC), may occur at higher rates of penetration, particularly at higher rotational speeds, and is at least in part attributable to a phenomenon known as "whirl" or "bit whirl." Radially directed centrifugal imbalance forces exist to some extent in every rotating drill bit and drill string. Such forces are in part attributable to mass imbalance within the drill bit and in part to dynamic forces generated by contact of the drill bit with the formation. In the latter instance, aggressive cutter placement and orientation creates a high tangential cutting force relative to the normal force applied to the bit and aggravates the imbalance. In any event, these imbalance forces tend to cause the drill bit to rotate or roll about the bore hole in a direction counter to the normal direction of rotation imparted to the bit during drilling. This counter-rotation is termed "whirl," and is a self-propagating phenomenon, as the side forces on the bit cause its center of rotation to shift to one side, after which there is an immediate tendency to shift again. Since cutting elements are designed to cut and to resist impact received in the normal direction of bit rotation (clockwise, looking down a drill string), contact of the cutting elements with the bore hole wall in a counter-clockwise direction due to whirl can place stresses on the cutting elements beyond their designed limits.

One solution to the problems caused by bit whirl has been to focus or direct the imbalance forces as a resultant side force vector to a particular side of the bit via changes in cutting element placement and orientation and bit mass location, and to cause the bit to ride on a low-friction bearing zone or pad on the gage of that side of the bit, thus substantially reducing the drill bit/bore hole wall tangential forces which induce whirl. This solution is disclosed in U.S. Pat. Nos. 4,982,802; 4,932, 484; 5,010,789 and 5,042,596, all assigned on their faces to Amoco Corporation of Chicago, Ill.

The above-referenced U.S. Patents conventionally require that the low friction bearing zone or pad on the gage and adjacent bit profile or flank be devoid of cutting elements and, indeed, many alternative bearing zone configurations are disclosed, including wear coatings, diamond stud inserts, diamond pads, rollers, caged ball bearings, etc. It has also been suggested by others that the bearing zone on the bit gage may include cutting elements of different sizes, configurations, depths of cut and/or rake angles than the cutting elements located in the cutting zone of the bit, which extends over the bit face from the cutting elements thereof outwardly to the gage, except in the flank area of the face adjacent the bearing zone. However, as represented in the prior art, such bearing zone cutting elements undesirably generate lesser cutting forces than the cutting elements in the cutting zone of the bit so that the bearing zone will have a relatively lower coefficient of friction. See U.S. Pat. No. 4,982,802, Col. 5, lines 29-36; U.S. Pat. No. 5,042,596, Col. 4, lines 18-25. Furthermore, while the prior art provides for focusing or directing the imbalance forces as a resultant side force vector toward a particular side of the bit, it does so by compromising cutting aggressiveness of the bit, particularly affecting the placement and aggressiveness of cutting elements. Moreover, while the above-referenced patents reduce tangential forces, which are generally noted to induce whirl, they do not protect the cutting elements from damage as a result of the impact loads caused by vibrational instabilities commensurate with bit whirl, particularly when drilling in harder subterranean formations.

In order to mitigate the damage upon the cutting elements caused by side impact forces, conventional wisdom has been to direct the imbalance force, i.e., the resultant side force vector, of the bit toward the center of the bit blade and trailing bearing surface of a bit blade or toward the gage region of a particular bit blade, which undesirably limits cutter placement and configuration and other features of the design of the bit. Damage to the cutting elements may also be mitigated by increasing the circumferential width of the bearing surface, which undesirably reduces the hydraulic cross-section available for the junks slot, thus reducing hydraulic flow of drilling fluid and potentially decreasing the volume of cuttings which may be carried therethrough by the drilling fluid. In order to improve the stability of the bit while militating against damage, the bearing surface has been extended across the width of one or more channels between blades. Such bits are known as so called "steering wheel" drill bits and generally include fins or cylindrical portions that extend the bearing surface circumferentially about the gage region of the drill bit as shown and described in U.S. Pat. Nos. 5,671,818, 5,904,213 and 5,967,246. While these so called "steering wheel" drill bits may increase stability by militating against vibrational instabilities and enhance the ability of such bits to hold bore hole gage diameter, such drill bits undesirably increase the outer perimeter surface of the bit bearing on the bore hole side wall, making directional drilling more difficult. Furthermore, the configuration of such so called "steering wheel" drill bits also undesirably reduces the available hydraulic cross-section of the junk slots and may restrict removal of formation cuttings from the drill bit face by substantially circumscribing the flow channels provided by the junk slots. In addition, the configuration of the steering wheel drill bits impedes tripping the drill bit in and out of the bore hole, and may cause swabbing (removal of formation material from the bore hole side wall) during tripping.

Another solution to mitigate the damage upon the cutting elements caused by side impact forces is provided in U.S. patent application Ser. No. 11/865,296, titled "Drill Bits and Tools For Subterranean Drilling," filed Oct. 1, 2007, and U.S. patent application Ser. No. 11/865,258, titled "Drill Bits and Tools For Subterranean Drilling," filed Oct. 1, 2007, which are owned by the assignee of the present invention, and which disclosures are incorporated herein in their entirety by reference.

While the above mentioned solutions have reduced, in some aspects, instability of the bit due to bit whirl in order to increase rotational speed and, resultantly, rate of penetration, the face surface (particularly the face surfaces of the blades) of the bit limits rate of penetration due to rubbing contact with a subterranean formation. The face surface of each blade has a continuous contoured radially and laterally extending profile, or engagement surface, that is substantially attributable to cutter profile design and structural support of the cutting elements. In other instances, the face surface of each blade has a continuous contoured radially and laterally extending profile, or engagement surface that is extended rotationally to accommodate the greater structural extent required by the bearing surface of the gage pads required for increased stability.

Accordingly, it is desirable to provide improvements for a drill bit to increase rate of penetration undiminished by the extent of rubbing contact between the drill bit and a subterranean formation. Moreover, it is desirable to provide improvements for a drill bit to maintain or enhance stability by reducing lateral motion affected by bit whirl while providing increased rate of penetration undiminished by the extent of rubbing contact between the drill bit and a subterranean formation.

BRIEF SUMMARY OF THE INVENTION

In one embodiment, a drill bit includes a controlled or engineered rubbing surface for a blade face surface of a blade of a bit body in order to reduce the amount of rubbing contact, particularly in at least one of the cone region, nose region and shoulder region of the blade, with a formation. The controlled or engineered rubbing surface for the blade face surface provides, without sacrificing cutting element exposure and placement, a degree of rubbing that may be controlled by an amount of sweep applied to a trailing portion of the blade face surface of the blade.

In other embodiments, a drill bit having a bit body includes a blade face surface on at least one blade extending longitudinally and radially outward over a face of the bit body. The blade face surface of the at least one blade includes a contact zone and a sweep zone. The sweep zone rotationally trails the contact zone with respect to a direction of intended bit rotation about a longitudinal axis of the bit body and provides reduce rubbing contact when engaging with a subterranean formation.

Advantageously, embodiments of the invention provide a blade face surface for a drill bit allowing for increased rate of penetration undiminished by the extent of rubbing contact between the drill bit and a subterranean formation particularly when the rubbing contact is attributable to WOB. Moreover, other embodiments of the invention provide a drill bit capable of maintaining or enhancing stability by reducing lateral motion affected by bit whirl while providing increased rate of penetration undiminished by the extent of rubbing contact under WOB between the drill bit and a subterranean formation.

Other advantages and features of the invention will become apparent when viewed in light of the detailed description of the various embodiments of the invention when taken in conjunction with the attached drawings and appended claims.

DETAILED DESCRIPTION OF THE INVENTION

Figure 1:
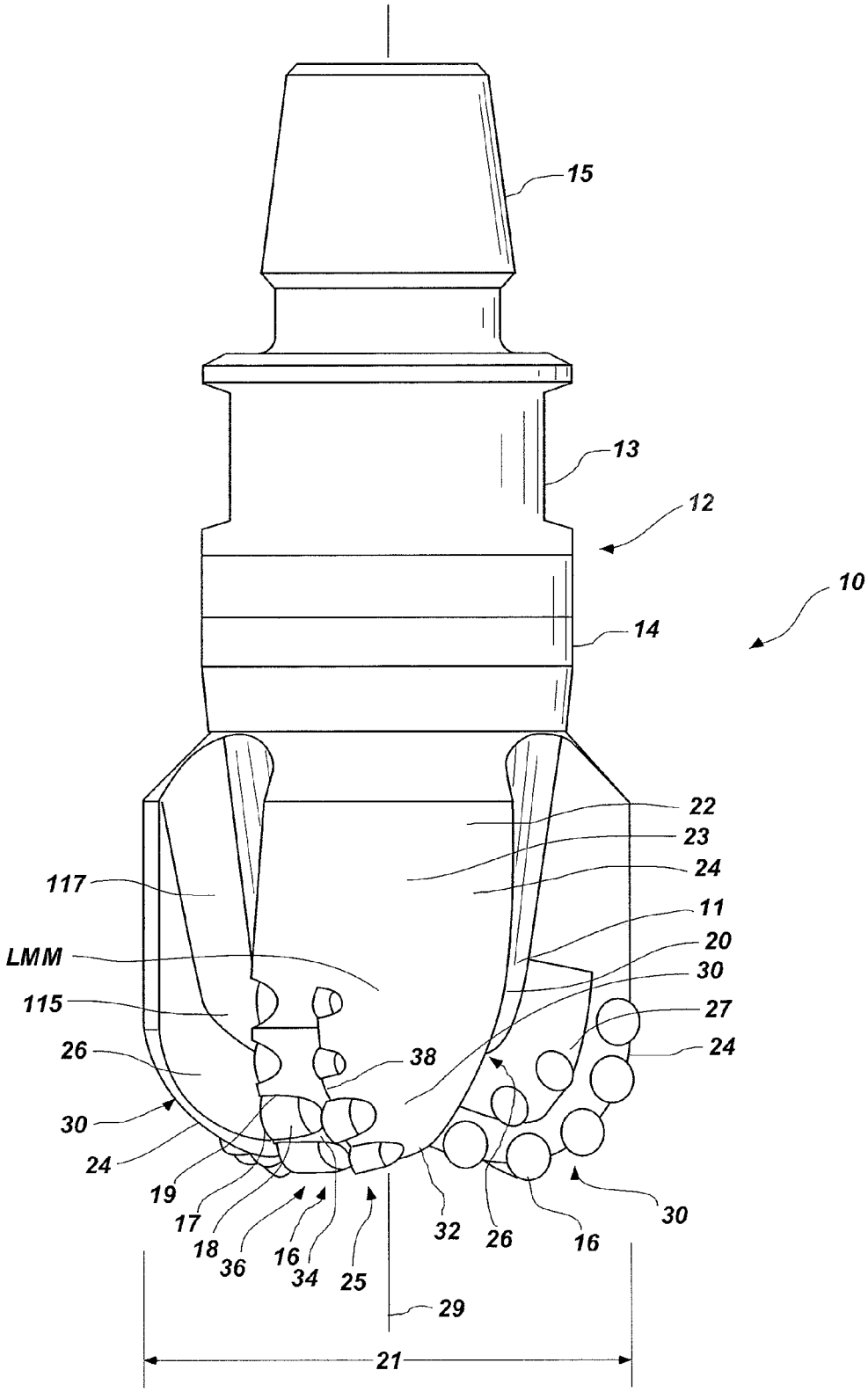
FIG. 1 shows a perspective, side view of a drill bit configured with sweep zones according to an embodiment of the invention.

In the description which follows, like elements and features among the various drawing figures are identified for convenience with the same or similar reference numerals.

The various drawings depict an embodiment of the invention as will be understood by the use of ordinary skill in the art and are not necessarily drawn to scale. The term "sweep" as used herein is broad and is not limited in scope or meaning to any particular surface contour or construct. The term "sweep" may be replaced with anyone of the following terms "recessed," "reduced," "decreased," "cut," "diminished," "lessened," and "tapered," each having like or similar meaning in context of the specification and drawings as described and shown herein. The term "sweep" has been employed throughout the application in the context of describing the degree to which a "segment," "portion," "surface," and/or "zone" of a blade face surface may be generally removed from direct rubbing contact with a subterranean formation relative to another "segment," "portion," "surface," and/or "zone" of the blade face surface of a blade in intended rubbing contact with the subterranean formation while drilling.

FIG. 1 shows a perspective, side view (with respect to the usual orientation thereof during drilling) of a drill bit 10 configured with sweep zones 30, according to an embodiment of the invention. The drill bit 10 is configured as a fixed cutter rotary full bore drill bit, also known in the art as a "drag" bit. The drill bit 10 includes a bit crown or body 11 comprising, for example, tungsten carbide particles infiltrated with a metal alloy binder, a machined steel casting or forging, or a sintered tungsten or other suitable carbide, nitride or boride material as discussed in further detail below. The bit body 11 may be coupled to a support 12. The support 12 includes a shank 13 and a crossover component 14 coupled to the shank 13 in this embodiment of the invention. It is recognized that the support 12 may be made from a unitary material piece or multiple pieces of material in a configuration differing from the shank 13 being coupled to the crossover component 14 by weld joints as described with respect to this particular embodiment. The shank 13 of the drill bit 10 includes a pin comprising male threads 15 that is configured to API standards and adapted for connection to a component of a drill string (not shown). Blades 24 that radially and longitudinally extend from a face 20 of the bit body 11 outwardly to a full gage diameter 21 each have mounted thereon a plurality of cutting elements, generally designated by reference numeral 16. Each cutting element 16 comprises a polycrystalline diamond compact (PDC) table 17 formed on a cemented tungsten carbide substrate 18. The cutting elements 16, conventionally secured in respective cutter pockets 19 by brazing, for example, are positioned to cut a subterranean formation being drilled when the drill bit 10 is rotated in a clock-wise direction looking down the drill string under weight on-bit (WOB) in a bore hole. In order to enhance rubbing contact control without altering the desired placement or depth of cut (DOC) of the cutting elements 16, or their constituent cutter profiles as understood by a person having ordinary skill in the art, a sweep zone 30 is included on each blade 24. The sweep zone 30 rotationally trails the cutting elements 16 to prescribe a sweep surface 32 over a portion of a blade face surface 25 of associated blade 24. The prescribed, or sweep surface 32 allows a rubbing portion 34 in a contact zone 36 of a blade face surface 25 to provide reduced or engineered surface-to-surface contact when engaging a subterranean formation while drilling. Stated another way, each sweep zone 30 may be said, in some embodiments, to rotationally reduce a portion (i.e., the sweep surface 32) of the blade face surface 25 back and away from the rotationally leading cutting elements 16 toward a rotationally trailing edge, or face 26 on a given blade 24 to enhance rubbing contact control by affording the rubbing portion 34 in the contact zone 36 of the blade face surface 25, substantially not extending into the sweep zone 30, to principally support WOB while engaging to drill a subterranean formation without exceeding the compressive strength thereof. In this regard, the recessed portion of the sweep zone 30 is substantially removed (with respect to the rubbing portion 34 of leading blade face surface 25 not extending into the sweep zone 30) from rubbing contact with a subterranean formation while drilling. Advantageously, the sweep zone 30 allows for enhanced rubbing control while maintaining conventional, or desired, features on the blade 24, such as support structure necessary for securing the cutting elements 16 (particularly with respect to obtaining, without distorting, a desired cutter profile) to the blade 24 and providing a bearing surface 23 on a gage pad 22 of the blade 24 for enhancing stability of the bit 10 while drilling. Still other advantages are afforded by the sweep zone 30, such as allowing the blade face surface 25 to have engineered weight per unit area, or pressure, designed for the intended operating WOB. Each contact zone 36 of the blade face surfaces 25 substantially rotationally extends from the rotationally leading edge or face 27 of each blade 24 to a sweep demarcation line 38 (also, see FIG. 3). The sweep demarcation line 38 indicates, generally, division between where the contact zone 36 and the sweep zone 30 rotationally end and begin, respectively, and represents demarcation between substantial and insubstantial rubbing contact with a subterranean formation when drilling with the bit 10. Each sweep zone 30 may be configured according to an embodiment of the invention, as further described hereinafter.

Figure 2:
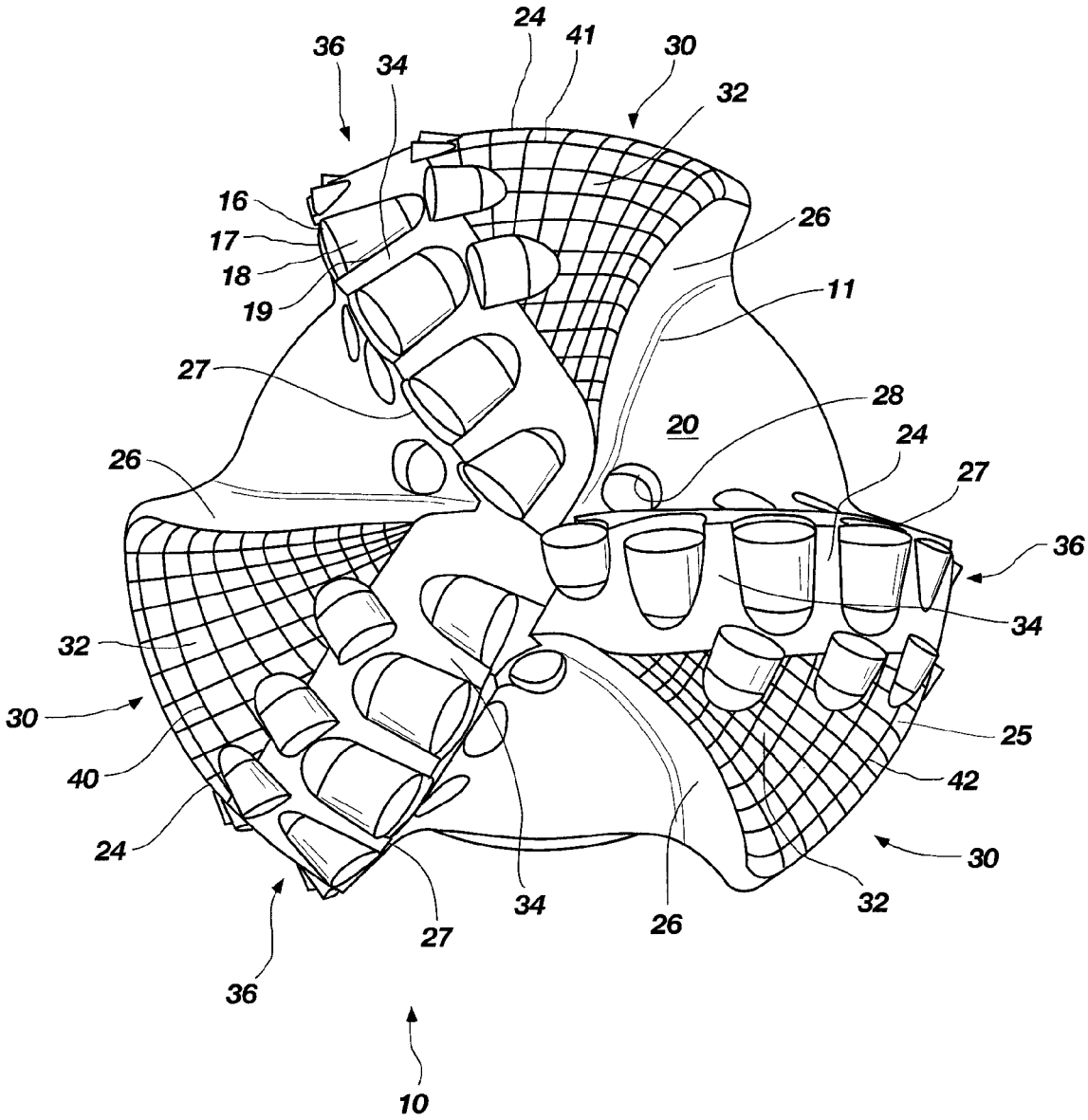
FIG. 2 shows a face view of the drill bit as shown in FIG. 1 illustrating the configured sweep zones with an overlaid grid.
Figure 3:
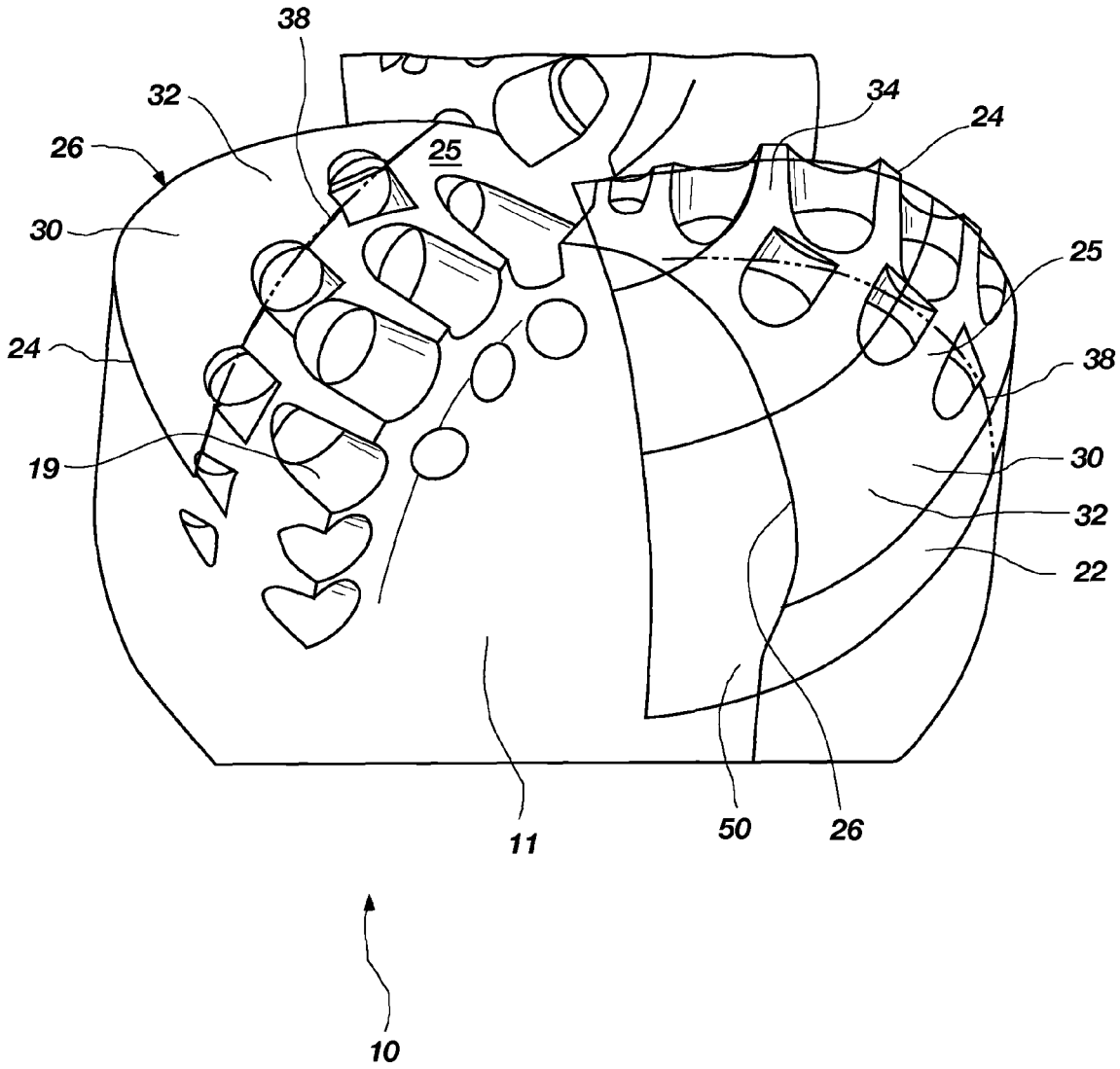
FIG. 3 shows a partial, perspective view of a bit body of the drill bit as shown in FIG. 1 illustrating the amount of sweep applied to in one sweep zone with an overlaid envelope.

Before describing a sweep zone 30 in further detail in accordance with the invention as shown in FIGS. 1 through 3, the bit 10 as shown in FIG. 1 will be first described generally in further detail. As previously mentioned, the bearing surface 23 on the gage pad 22 enhances stability of the bit 10 and protects the cutting elements 16 from the undesirable impact stresses caused particularly by bit whirl and lateral movement to improve stability of the drill bit 10 by reducing the propensity for lateral movement of the bit 10 while drilling and, in turn, any propensity of the bit 10 to whirl. In this regard, the bearing surface 23 of the gage pad 22 is a lateral movement mitigator (LMM) bounded by the sweep zone 30 at its full radial extent of the blade 24 adjacent to the gage pad 22 in the gage region thereof, to improve both stability and rubbing contact control of the bit 10 while drilling. Also, during drilling, drilling fluid is discharged through nozzles (not shown) located in ports 28 (see FIG. 2) in fluid communication with the face 20 of bit body 11 for cooling the PDC tables 17 of cutting elements 16 and removing formation cuttings from the face 20 of drill bit 10 as the fluid moves into passages 115 and through junk slots 117. The nozzles may be sized for different fluid flow rates depending upon the desired flushing required in association with each group of cutting elements 16 to which a particular nozzle assembly directs drilling fluid.

The sweep zones 30 may be formed from the material of the bit body 11 and manufactured in conjunction with the blades 24 that extend from the face 20 of the bit body 11. The material of the bit body 11 and blades 24 with associated sweep zones 30 of the drill bit 10 may be formed, for example, from a cemented carbide material that is coupled to the body blank by welding, for example, after a forming and sintering process and is termed a "cemented" bit. The cemented carbide material in this embodiment of the invention comprises tungsten carbide particles in a cobalt-based alloy matrix made by pressing a powdered tungsten carbide material, a powdered cobalt alloy material and admixtures that may comprise a lubricant and adhesive, into what is conventionally known as a green body. A green body is relatively fragile, having enough strength to be handled for subsequent furnacing or sintering, but not strong enough to handle impact or other stresses required to prepare the green body into a finished product. In order to make the green body strong enough for particular processes, the green body is then sintered into the brown state, as known in the art of particulate or powder metallurgy, to obtain a brown body suitable for machining, for example. In the brown state, the brown body is not yet fully hardened or densified, but exhibits compressive strength suitable for more rigorous manufacturing processes, such as machining, while exhibiting a relatively soft material state to advantageously obtain features in the body that are not practicably obtained during forming or are more difficult and costly to obtain after the body is fully densified. While in the brown state for example, the cutter pockets 19, nozzle ports 28 and the sweep surface 32 of associated sweep zone 30 may also be formed in the brown body by machining or other forming methods. Thereafter, the brown body is sintered to obtain a fully dense cemented bit.

As an alternative to tungsten carbide, one or more of boron carbide, boron nitride, aluminum nitride, tungsten boride and carbides or borides of Ti, Mo, Nb, V, Hf, Zr, Ta, Si and Cr may be employed. As an alternative to a cobalt-based alloy matrix material, or one or more of iron-based alloys, nickel-based alloys, cobalt- and nickel-based alloys, aluminum-based alloys, copper-based alloys, magnesium-based alloys, and titanium-based alloys may be employed.

In order to maintain particular sizing of machined features, such as cutter pockets 19 or nozzle ports 28, displacements, as known to those of ordinary skill in the art, may be utilized to maintain nominal dimensional tolerance of the machined features, e.g., maintaining the shape and dimensions of a cutter pocket 19 or nozzle port 28. The displacements help to control the shrinkage, warpage or distortion that may be caused during the final sintering process required to bring the green or brown body to full density and strength. While the displacements help to prevent unwanted nominal changes in associated dimensions of the brown body during final sintering, invariably, critical component features, such as threads, may require reworking prior to their intended use, as the displacement may not adequately prevent against shrinkage, warpage or distortion.

While sweep zones 30 are formed in the cemented carbide material of the drill bit 10 of this embodiment of the invention, a drill bit may be manufactured in accordance with embodiments of the invention using a matrix bit body or a steel bit body as are well known to those of ordinary skill in the art, for example, without limitation. Drill bits, termed "matrix" bits are conventionally fabricated using particulate tungsten carbide infiltrated with a molten metal alloy, commonly copper based. Steel body bits comprise steel bodies generally machined from castings or forgings. While steel body bits are not subjected to the same manufacturing sensitivities as noted above, steel body bits may enjoy the advantages of the invention as described herein, particularly with respect to having sweep zones 30 formed or machined into the blade 24 for improving pressure and rubbing control upon the blade face surface 25 caused by WOB and for further controlling a rubbing area in contact with a subterranean formation while drilling.

The sweep zones 30 may be distributed upon or about the blade face surface 25 of respective, associated blades 24 to symmetrically or asymmetrically provide for a desired rubbing area control surface (i.e., the rubbing portion 34 of the contact zone 36) upon the drill bit 10, respectively during rotation about axis 29.

FIG. 2 shows a face view of the drill bit 10 shown in FIG. 1 configured with sweep zones 30. Reference may also be made back to FIG. 1. The sweep zones 30 advantageously enhance the degree of rubbing when drilling a subterranean formation with a bit 10 by controlling the amount of sweep applied to the sweep surface 32 to effect reduced rubbing engagement over a portion of rotationally trailing blade face surface 25 of each blade 24 when drilling. Sweep zones 30 are included upon the blade face surface 25 of each blade 24 forming a rotationally symmetric structure as illustrated by overlaid grids, indicated by numerical designations 40, 41 and 42. The overlaid grids 40, 41 and 42 form no part of the drill bit 10, but are representative of the sweep zone 30 as described with respect to FIG. 2. Each sweep zone 30 includes a sweep surface 32 of a blade face surface 25 as represented by numerical designations 40, 41 and 42, allowing the remaining portion of the blade face surface 25 (i.e., the rotationally leading rubbing portion 34 of the blade face surface 25) to principally engage, in rubbing contact, the formation while drilling. It is recognized that each sweep zone 30 may be asymmetrically oriented upon the surface of the blade face surface 25 different from the symmetrically oriented sweep zone 30 as illustrated, respectively. Moreover, it is to be recognized that each sweep surface 32 may have to a greater or lesser extent total surface area that is different from the equally sized sweep surfaces 32 as illustrated, respectively.

FIG. 3 shows a partial, perspective view of a bit body 11 of the drill bit 10 as shown in FIG. 1 configured with sweep zones 30. The bit body 11 in FIG. 3 is shown without cutting elements affixed into the cutter pockets 19. Representatively, the sweep zone 30 rotationally sweeps, in order to reduce the amount of intended rubbing contact with the bit 10, a sweep surface 32 of the blade face surface 25 below a conventional envelope comprising the blade face surface 25 as illustrated by numerical designation 50. The envelope 50 forms no part of the drill bit 10, but is illustrative of the degree to which the underlying sweep surface 32 of the sweep zone 30 is rotationally receded, in both lateral and radial extent, in order to reduce, by controlling, the extent to which rubbing contact occurs when drilling a subterranean formation. It is noted that the envelope 50 shows the extent to which rubbing contact may persist, particularly upon the gage pad 22 of the blade 24 and the rubbing portion 34 of the blade face surface 25 of the blade 24. In this embodiment, each sweep surface 32 of the sweep zones 30, respectively, are uniformly rotationally reduced (laterally and radially) to fifty-eight thousands of an inch (0.058") at respective rotationally trailing faces 26 of the blades 24 beginning from respective sweep demarcation lines 38 of the blade face surfaces 25. It is to be recognized that the extent to which the sweep surface 32 is recessed with respect to the rubbing portion 34 may be greater or lesser than the fifty-eight thousands of an inch, as illustrated. Moreover, the geometry over which the sweep surface 32 is recessed within the sweep zone 30 may be irregular, stepped, or non-uniform, from the longitudinal axis 29 (see FIG. 1) of the bit body 12 and around the length of the sweep zone 30, from the uniformly sweep surface 32 as illustrated.

In embodiments of the invention, a sweep surface 32 may be provided in a sweep zone 30 upon one or more blades 24 to reduce the amount of rubbing over the blade face surface 25. In this respect, the amount of desired rubbing may be controlled by a rubbing portion 34 in the contact zone 36 of the blade face surface 25, while advantageously maintaining, without distorting, a preferred cutter exposure associated with the cutting elements 16 and cutter profile (not shown) associated therewith. The sweep surface 32 may extends continuously, as seen in FIGS. 1 through 3, or discontinuously over the cone region, the nose region and the shoulder region substantially extending to the gage region of the bit 10.

In other embodiments of the invention, multiple sweep surfaces 32 may be provided in a sweep zone 30 upon one blade 24 of a bit 10 or upon a plurality of blades 24 on a bit 10. Each of the multiple sweep surfaces 32 may rotationally trail an adjacent rubbing portion 34 of a contact zone 36 of a bit being concentrated in at least one of the cone region, the nose region and the shoulder region of the bit 10.

It is recognized that a sweep zone 30 in accordance with any of the embodiments of the invention mentioned herein, may be configured with any conceivable geometry that reduces the amount of rubbing exposure of a sweep surface in order to provide a degree of controlled rubbing upon a rubbing portion of a blade face surface of a blade without substantially effecting cutting element exposure, cutter profile and cutter placement thereupon. Advantageously, the degree of controlled rubbing may provide enhanced stability for the bit, particularly when subjected to dysfunctional energy caused or induced by WOB.

In further embodiments, a drill bit includes a controlled or engineered rubbing surface for a blade face surface of a blade of a bit body in order to reduce the amount of rubbing contact, particularly in at least one of the cone region, nose region and shoulder region of the blade, with a formation. The controlled or engineered rubbing surface for the blade face surface provides, without sacrificing cutting element exposure and placement, a degree of rubbing that may be controlled by an amount of sweep applied to a trailing portion of the blade face surface of the blade.

It is recognized that the blade face surface of the blade of the bit body may be formed in a casting process or machined in a machining process to construct the bit body, respectively. The invention, generally, adds a detail to the face of a blade that "sweeps" rotationally across the surface of the face of the blade to provide a geometry capable of limiting the amount of rubbing contact seen between the face of the blade and a subterranean formation while also providing for, or maintaining, conventional cutting element exposures and cutter profiles.

In other embodiments, a drill bit includes a controlled or engineered rubbing surface on a blade face surface in order to provide an amount of rubbing control for increasing the rate of penetration while combining structure for increased stability while drilling in a subterranean formation. This structure is disclosed in U.S. patent application Ser. No. 11/865,296, titled "Drill Bits and Tools For Subterranean Drilling," filed Oct. 1, 2007, and U.S. patent application Ser. No. 11/865,258, titled "Drill Bits and Tools For Subterranean Drilling," filed Oct. 1, 2007, which are owned by the assignee of the present invention, and which disclosures are incorporated herein, in their entirety, by reference.

Figure 4A:
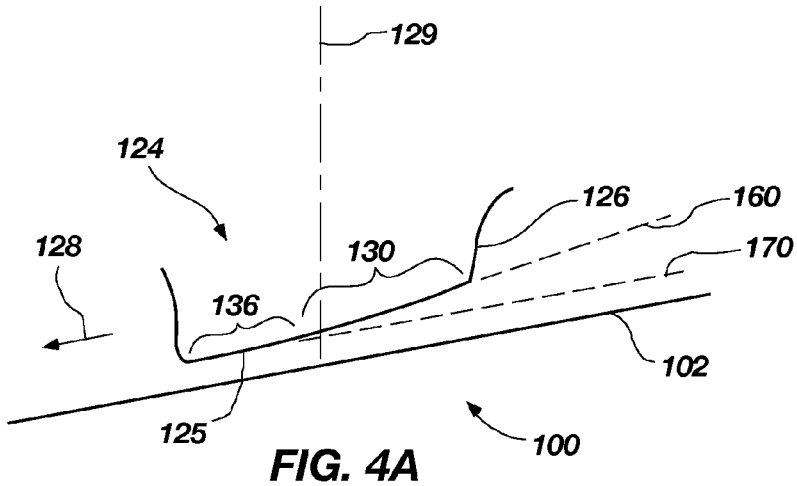
FIGS. 4A-4C show profiles of sweep zones, respectively, in accordance with embodiments of the invention.
Figure 4B:
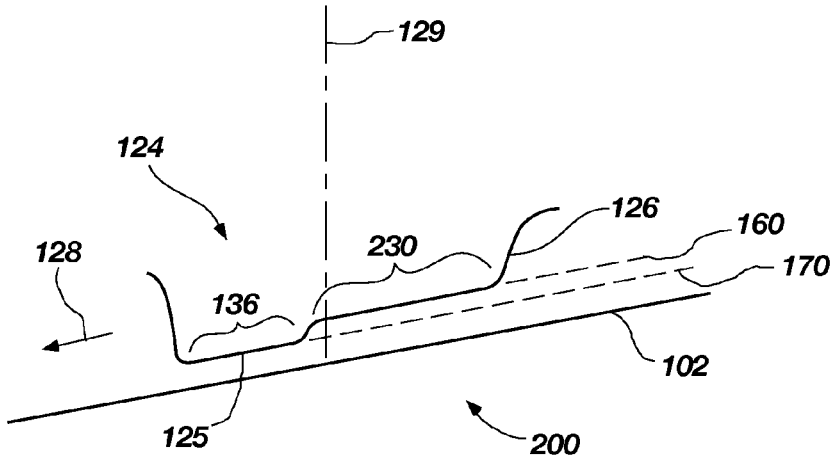
Figure 4C:
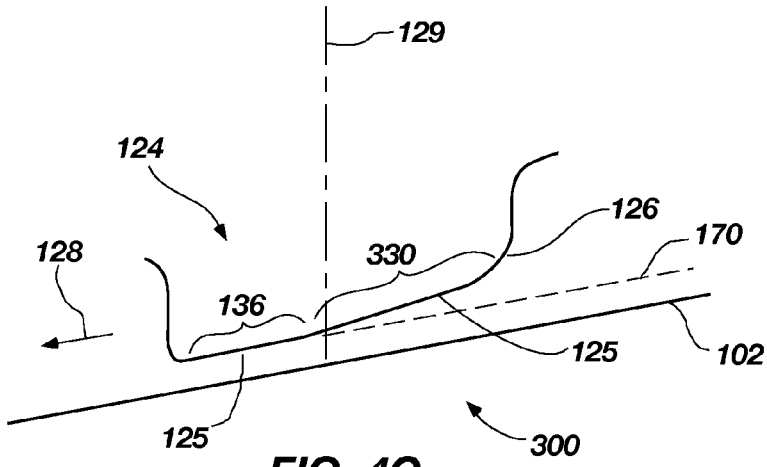

FIGS. 4A-4C show profiles 100, 200 and 300 of sweep zones 130, 230, 330, respectively, in accordance with embodiments of the invention. The sweep zones 130, 230, 330 are illustrated for a blade 124 of a drill bit taken in the direction of drill bit rotation 128 relative to a subterranean formation 102 and at a select radius (not shown) from the centerline 129 of the drill bit. Sweep zones 130, 230, 330 extend from a contact zone 136 on a blade face surface 125 to a rotationally trailing edge, or face 126 of the blade 124.

As shown in FIG. 4A, the sweep zone 130 is uniform across a respective portion of the blade face surface 125 to provide decreased rubbing as illustrated by the divergence between lines 160 and 170.

As shown in FIG. 4B, the sweep zone 230 is stepped across a respective portion of the blade face surface 125 to provide decreased rubbing as illustrated by the offset distance between lines 160 and 170. The sweep zone 230 may have more stepped portions than the stepped portion as illustrated.

As shown in FIG. 4C, the sweep zone 330 is non-linearly contoured across respective portion of the blade face surface 125 to provide decreased rubbing as illustrated by the divergence from line 170.

While profiles 100, 200 and 300 of sweep zones 130, 230, 330, respectively, have been shown and described, it is contemplated that the profiles 100, 200 and 300 may be combined or other profiles of various geometric configures are within the scope of the invention for providing sweep zones capable of decreasing and controlling the extent of rubbing contact between a blade face surface of a drill bit and a subterranean formation while drilling.

In embodiments of the invention, a sweep zone and/or a sweep surface are coextensive with a blade face surface of a blade. In further embodiments of the invention, a sweep zone and/or a sweep surface smoothly form a blade face surface of the blade. In still other embodiments of the invention, a sweep zone and/or a sweep surface are at least one of integral, continuous and unitary with a blade face surface of a blade.

While particular embodiments of the invention have been shown and described, numerous variations and other embodiments will occur to those skilled in the art. Accordingly, the scope of the present invention is limited by the appended claims and their legal equivalents.

What is claimed is:

1. A drill bit comprising:

a bit body having a longitudinal axis and a face extending to a gage region; and at least one blade having a portion extending over the face, the at least one blade having a blade face surface and a plurality of cutting elements disposed thereon, the blade face surface of the at least one blade comprising:

a contact zone extending from a leading edge of the blade face surface, wherein at least one cutting element of the plurality of cutting elements is at least partially disposed on the contact zone of the blade face surface of the at least one blade; and a sweep zone rotationally trailing the contact zone with respect to a direction of intended bit rotation about the longitudinal axis of the bit body, wherein the sweep zone extends to a trailing edge of the blade face surface.

2. The drill bit of claim 1, further comprising a gage pad having a circumferential bearing surface in a gage region bounded by the blade face surface of the at least one blade.

3. The drill bit of claim 1, wherein the sweep zone rotationally trails the contact zone to a lesser radial extent and lesser lateral extent than a radial extent and lateral extent of the contact zone.

4. The drill bit of claim 1, wherein the blade face surface comprises a stepped surface being formed by the contact zone and the sweep zone wherein the contact zone exhibits a radial distance from the longitudinal axis of the bit body that is greater than a radial distance from the longitudinal axis of the bit body of the sweep zone.

5. The drill bit of claim 1, wherein the sweep zone comprises a non-linear sweep surface.

6. The drill bit of claim 5, wherein the non-linear sweep surface comprises a stepped surface.

7. The drill bit of claim 1, wherein the sweep zone and the contact zone are bounded by a sweep demarcation line.

8. The drill bit of claim 1, wherein the sweep zone comprises a plurality of sweep surfaces, at least one sweep surface of the plurality of sweep surfaces being disposed at a radial extent and longitudinal extent that is different than a radial extent and longitudinal extent of at least another sweep surface of the plurality of sweep surfaces.

9. The drill bit of claim 1, wherein the bit body includes a plurality of blades, each blade having a blade face surface and a plurality of cutting elements disposed thereon, each blade face surface of each blade comprising a contact zone and a sweep zone rotationally trailing the contact zone.

10. The drill bit of claim 9, wherein the contact zone and the sweep zone of each blade are rotationally oriented symmetrically about the bit body.

11. The drill bit of claim 1, wherein the at least one blade comprises a plurality of blades circumferentially separated by junk slots.

12. The drill bit of claim 1, further comprising a plurality of additional blades, at least one of the additional blades including a sweep zone associated therewith.

13. The drill bit of claim 1, wherein the contact zone and the sweep zone of the blade face surface form a continuous surface exhibiting a decreasing radius from the longitudinal axis of the bit body along a direction opposite to the direction of intended bit rotation about the longitudinal axis of the bit body.

14. A drill bit comprising:

a bit body having a longitudinal axis, and a face extending to a gage region; and at least one blade extending longitudinally and radially outward over the face having a rotationally trailing edge, a rotationally leading edge and a blade face surface rotationally extending between the rotationally trailing edge and the rotationally leading edge, the blade face surface comprising:

a rubbing portion including at least one cutting element at least partially disposed thereon; and at least one sweep surface rotationally adjacent the rubbing portion with respect to a direction of intended bit rotation about the longitudinal axis of the bit body to the sweep surface is less than a radial distance from the longitudinal axis of the bit body to the rubbing portion.

15. The drill bit of claim 14, wherein the at least one sweep surface and the rubbing portion of the blade face surface form a continuous surface exhibiting a decreasing radial distance from the longitudinal axis of the bit body along a direction opposite to the direction of intended bit rotation about the longitudinal axis of the bit body.

16. The drill bit of claim 14, wherein the at least one sweep surface comprises a plurality of sweep surfaces.

17. The drill bit of claim 16, wherein the plurality of sweep surfaces comprises at least one of a non-linear surface, a uniform surface, a non-uniform surface, a stepped surface, and an irregular surface.

18. The drill bit of claim 16, wherein at least two sweep surfaces of the plurality of sweep surfaces are at least one of adjacently located, segmented, and disposed to a different radial extent and longitudinal extent.

19. The drill bit of claim 14, wherein the bit body includes a plurality of blades, each blade having a blade face surface and a plurality of cutting elements disposed thereon, each blade face surface of each blade comprising a rubbing portion having at least cutting element of the plurality of cutting elements disposed thereon and at least one sweep surface rotationally trailing the rubbing portion.

20. The drill bit of claim 14, further comprising a plurality of additional blades, at least one of the additional blades including a sweep surface.

* * * * *

UNITED STATES PATENT AND TRADEMARK OFFICE

CERTIFICATE OF CORRECTION

PATENT NO. : 7,836,979 B2
APPLICATION NO. : 12/260245
DATED : November 23, 2010
INVENTOR(S) : James C. Green et al.

It is certified that error appears in the above-identified patent and that said Letters Patent is hereby corrected as shown below:

On the title page:

In ITEM (57) ABSTRACT

| | |
|---|---|
| LINE 7 | change "bit body provides reduce rubbing" to --bit body and provides reduced rubbing-- |

In the specification:

| | | |
|---|---|---|
| COLUMN 3, | LINE 55, | change "reduce rubbing" to --reduced rubbing-- |
| COLUMN 4, | LINE 29, | change "with anyone of" to --with any one of-- |
| COLUMN 5, | LINE 3, | change "clock-wise" to --clockwise-- |
| COLUMN 5, | LINE 4, | change "weight on-bit" to --weight-on-bit-- |
| COLUMN 5, | LINE 6, | change "depth of cut" to --depth-of-cut-- |
| COLUMN 5, | LINES 11, 12 | change "**25** of associated" to --**25** of an associated-- |
| COLUMN 8, | LINE 21, | change "may extends" to --may extend-- |
| COLUMN 8, | LINE 29, | change "of a bit" to --of a bit **10**-- |
| COLUMN 9, | LINE 27, | change "across respective" to --across a respective-- |

In the claims:

| | | | |
|---|---|---|---|
| CLAIM 14, | COLUMN 10, | LINE 60, | change "the longitudinal axis of the" to --the longitudinal axis, wherein a radial distance from the longitudinal axis of the-- |
| CLAIM 19, | COLUMN 12, | LINE 5, | change "at least cutting" to --at least one cutting-- |

Signed and Sealed this
Fifteenth Day of November, 2011

David J. Kappos

David J. Kappos
*Director of the United States Patent and Trademark Office*